US008890409B2

(12) United States Patent
Eden et al.

(10) Patent No.: US 8,890,409 B2
(45) Date of Patent: Nov. 18, 2014

(54) MICROCAVITY AND MICROCHANNEL PLASMA DEVICE ARRAYS IN A SINGLE, UNITARY SHEET

(75) Inventors: J. Gary Eden, Champaign, IL (US); Sung-Jin Park, Champaign, IL (US); Taek-Lim Kim, Champaign, IL (US); Kwang-Soo Kim, Champaign, IL (US)

(73) Assignee: The Board of Trustees of the University of Illnois, Urbana, IL (US)

( * ) Notice: Subject to any disclaimer, the term of this patent is extended or adjusted under 35 U.S.C. 154(b) by 482 days.

(21) Appl. No.: 12/991,237

(22) PCT Filed: May 14, 2009

(86) PCT No.: PCT/US2009/043974

§ 371 (c)(1), (2), (4) Date: Apr. 11, 2011

(87) PCT Pub. No.: WO2009/140509

PCT Pub. Date: Nov. 19, 2009

(65) Prior Publication Data

US 2011/0181169 A1 Jul. 28, 2011

Related U.S. Application Data

(60) Provisional application No. 61/127,559, filed on May 14, 2008.

(51) Int. Cl.
*H01J 17/49* (2012.01)
*H01J 9/26* (2006.01)

(Continued)

(52) U.S. Cl.
CPC . *H05H 1/24* (2013.01); *H01J 11/36* (2013.01); *H01J 61/86* (2013.01)
USPC ..... 313/586; 313/631; 313/582; 313/492; 313/306; 313/620; 313/623; 205/106; 445/25

(58) Field of Classification Search
CPC ..... H01J 61/366; H01J 61/36; H01J 61/368; H01J 61/86; H01J 61/0732; H01J 61/00; H01J 61/02; H01J 61/04; H01J 11/16; H01J 11/32; H01J 2211/245; H01J 2211/326; H01J 11/12; H01J 11/38; H01J 11/36; H01J 11/24; H05H 1/24
USPC ..... 313/582–587, 631, 483–486, 492–493, 313/461, 306, 618, 623; 445/24–25, 72; 205/106
See application file for complete search history.

(56) References Cited

U.S. PATENT DOCUMENTS 6,867,548 B2 3/2005 Eden et al.
7,112,918 B2 9/2006 Eden et al.

(Continued)

FOREIGN PATENT DOCUMENTS

JP 10-121292 5/1998
JP 10-237197 9/1998

(Continued)

OTHER PUBLICATIONS

Kim. K. S. et al., "Self patterned aluminum interconnects and ring electrodes for arrays of microcavity plasma devices encapsulated in AI203", *J. Phys. D. Appl. Phys. 2008*—iop.org, published online Dec. 12, 2007 at stacks.iop.org.

(Continued)

*Primary Examiner* — Nimeshkumar Patel
*Assistant Examiner* — Jose M Diaz
(74) *Attorney, Agent, or Firm* — Greer, Burns & Crain, Ltd.

(57) ABSTRACT

An array of microcavity plasma devices is formed in a unitary sheet of oxide with embedded microcavities or microchannels and encapsulated metal driving electrodes isolated by oxide from the microcavities or microchannels and arranged so as to generate sustain a plasma in the embedded microcavities or microchannels upon application of time-varying voltage when a plasma medium is contained in the microcavities or microchannels.

33 Claims, 15 Drawing Sheets

(51) Int. Cl.

| | |
|---|---|
| ***H01J 9/32*** | (2006.01) |
| ***H05H 1/24*** | (2006.01) |
| ***H01J 61/86*** | (2006.01) |
| *H01J 11/36* | (2012.01) |

(56) References Cited

U.S. PATENT DOCUMENTS

| | | | | |
|---|---|---|---|---|
| 7,642,720 | B2 | 1/2010 | Eden et al. | |
| 8,179,032 | B2 | 5/2012 | Eden et al. | |
| 8,362,699 | B2 | 1/2013 | Eden et al. | |
| 2002/0014621 | A1 | 2/2002 | Den et al. | |
| 2005/0148270 | A1 | 7/2005 | Eden et al. | |
| 2005/0258747 | A1* | 11/2005 | Song et al. | 313/582 |
| 2006/0071598 | A1 | 4/2006 | Eden et al. | |
| 2006/0082319 | A1 | 4/2006 | Eden et al. | |
| 2007/0007891 | A1* | 1/2007 | Kim et al. | 313/509 |
| 2007/0108910 | A1 | 5/2007 | Eden et al. | |
| 2007/0114936 | A1 | 5/2007 | Park et al. | |
| 2007/0170866 | A1 | 7/2007 | Eden et al. | |
| 2007/0188098 | A1* | 8/2007 | Kwon et al. | 313/582 |
| 2007/0236145 | A1* | 10/2007 | Kang et al. | 313/582 |
| 2007/0240986 | A1 | 10/2007 | Reymond et al. | |
| 2008/0013820 | A1 | 1/2008 | Vertoprakhov et al. | |
| 2008/0129185 | A1 | 6/2008 | Eden et al. | |
| 2008/0185579 | A1 | 8/2008 | Eden et al. | |
| 2008/0290799 | A1 | 11/2008 | Eden et al. | |
| 2010/0001629 | A1 | 1/2010 | Eden et al. | |
| 2011/0260609 | A1 | 10/2011 | Eden et al. | |
| 2011/0275272 | A1 | 11/2011 | Eden et al. | |
| 2012/0025696 | A1 | 2/2012 | Eden et al. | |

FOREIGN PATENT DOCUMENTS

| | | |
|---|---|---|
| WO | WO 2007/011865 | 1/2007 |
| WO | WO 2007/087285 | 8/2007 |
| WO | WO 2008/013820 | 1/2008 |
| WO | WO 2009/140509 | 11/2009 |
| WO | WO 2012-015943 | 2/2012 |

OTHER PUBLICATIONS

Jessensky, O., "Self-organized formation of hexagonal pore arrays in anodic alumina", *Applied Physics Letters*, vol. 72, No. 10, Mar. 9, 1998.

Kim, Kwang-Soo, et. al., "27.3: Fully Addressable, Self-Assembled Microcavity Plasma Arrays: Improved Luminous Efficacy by Controlling Device Geometry", *SID 08 DIgest*, 2008.

Park, Sung-Jin et. al., "Flexible microdischarge arrays: Metal/polymer devices", *Applied Physics Letters*, vol. 77, No. 2, Jul. 10, 2000.

Park, Sung-Jin et. al., "Microdischarge Arrays: A New Family of Photonic Devices", *IEEE Journal on Selected Topics in Quantum Electronics*, vol. 8, No. 1, Jan./Feb. 2002.

Park, Sung-Jin, et. al., "Nanoporous alumina as a dielectric for microcavity plasma devices: Multilayer $Al/Al_2O_3$ structures", *Applied Physics Letters*, 86, 2005.

Park, Sung-Jin, et. al., "40 000 pixel arrays of ac-excited silicon microcavity plasma devices", *Applied Physics Letters*, 86, 2003.

Park, Sung-Jin, et. al., "P-90: Large Scale Arrays of Microcavity Plasma Devices Based on Encapsulated $Al/Al_2O_3$ Electrodes: Device Characteristics as a Plasma Display Pixel and Low Cost Wet Chemical Fabrication Processing", *SID 07 Digest*, 2007.

Park, Sung-Jin, et. al., "Lighting from thin (<1mm) sheets of microcavity plasma arrays fabricated in $Al/Al_2O_3$ /glass structures: planar, mercury-free lamps with radiating areas beyond 200 $cm^2$", *J. Phys. D: Appl. Phys.*, 40, 2007, p. 3907-3913.

Sakai, Osamu, et. al. "Microplasma Array Serving as Photonic Crystals and Plasmon Chains", *Plasma and Fusion Research: Regular Articles*, vol. 4, 052, 2009.

Park, S-J., et. al., "Performance of Microdischarge Devices and Arrays with Screen Electrodes", *Photonics Technology Letters, IEEE*, vol. 13, Issue 1, Jan. 2001.

* cited by examiner

20
Al Foil 20
14
Initial Anodization

24
PR Patterning

AAO Removal

Electrochemical Etching

PR Removal 12
14
16
10
Full Anodization 12
16
10a
Partial Anodization

Al Foil
20

Initial Anodization
20
14

PR Patterning
24

AAO Removal

Electrochemical Etching

PR Removal
16

Full Anodization
10
12
14

20
24

14
Al
20
24

14
Al
20
24

Al
Al
Al
Al
20
20
14
20
14
24
20
14
24
20
14
24
14
12
10
34

MICROCAVITY AND MICROCHANNEL PLASMA DEVICE ARRAYS IN A SINGLE, UNITARY SHEET

PRIORITY CLAIM AND REFERENCE TO RELATED APPLICATION

This application claims priority under 35 U.S.C. §119 and all other applicable statutes and treaties from prior U.S. Provisional Application Ser. No. 61/127,559, filed May 14, 2008.

STATEMENT OF GOVERNMENT INTEREST

This invention was made with government support under contract no. FA9550-07-1-003 awarded by Air Force Office of Scientific Research. The government has certain rights in the invention.

FIELD

A field of the invention is microcavity plasma devices. Another field of the invention is microchannel plasma devices.

BACKGROUND

Microcavity plasma devices produce a nonequilibrium, low temperature plasma within, and essentially confined to, a cavity having a characteristic dimension d below approximately 500 μm, and preferably substantially smaller, down to about 10 μm (at present). Such microplasma devices provide properties that differ substantially from those of conventional, macroscopic plasma sources. Because of their small physical dimensions, microplasmas normally operate at gas (or vapor) pressures considerably higher than those accessible to macroscopic devices. For example, microplasma devices with a cylindrical microcavity having a diameter of 200-300 μm (or less) are capable of operation at rare gas (as well as $N_2$ and other gases tested to date) pressures up to and beyond one atmosphere.

Such high pressure operation is advantageous. An example advantage is that, at these higher pressures, plasma chemistry favors the formation of several families of electronically-excited molecules, including the rare gas dimers ($Xe_2$, $Kr_2$, $Ar_2$, . . . ) and the rare gas-halides (such as XeCl, ArF, and $Kr_2F$) that are known to be efficient emitters of ultraviolet (UV), vacuum ultraviolet (VUV), and visible radiation. This characteristic, in combination with the ability of microplasma devices to operate in a wide range of gases or vapors (and combinations thereof), offers emission wavelengths extending over a broad spectral range. Furthermore, operation of the plasma in the vicinity of atmospheric pressure minimizes the pressure differential across the packaging material when a microplasma device or array is sealed. Operation at atmospheric pressure also allows for arrays of microplasmas to serve as microchemical reactors not requiring the use of vacuum pumps or associated hardware.

Research by the present inventors and colleagues at the University of Illinois has resulted in new microcavity and microchannel plasma device structures as well as applications. Recent work has resulted in microcavity and microchannel plasma devices that are easily and inexpensively formed in metal/metal oxide (e.g., $Al/Al_2O_3$) structures by simple anodization processes. Large-scale manufacturing of microplasma device arrays benefits from structures and fabrication methods that reduce cost and increase reliability. Of particular interest in this regard are the electrical interconnections between devices in a large array as well as the reproducible formation of electrodes having a precisely-controlled geometry.

The metal-metal oxide microplasma device arrays developed prior to the present invention have been formed by joining at least two sheets. Each separate sheet, e.g. a foil or screen, contains one of the two required driving electrodes for generating plasmas. These prior arrays work very well, but having two sheets typically requires alignment and bonding of the two pieces, and especially so if addressable arrays are to be formed. Precision alignment becomes challenging and potentially costly when the alignment error must be a small fraction of the microcavity cross-sectional dimension (typically 10-200 μm). Also, the bonding of separate electrode sheets can reduce the array lifetime because bonding increases the probability for electrical breakdown along the surface of one of the electrode.

DISCLOSURE OF INVENTION

An embodiment of the invention is an array of microcavity plasma devices formed in a unitary sheet of oxide with embedded microcavities or microchannels and encapsulated metal driving electrodes isolated by oxide from the microcavities or microchannels and arranged so as to generate and sustain a plasma in the embedded microcavities or microchannels upon application of time-varying voltage when a plasma medium is contained in the microcavities or microchannels.

DETAILED DESCRIPTION OF THE PREFERRED EMBODIMENTS

Figure 1:
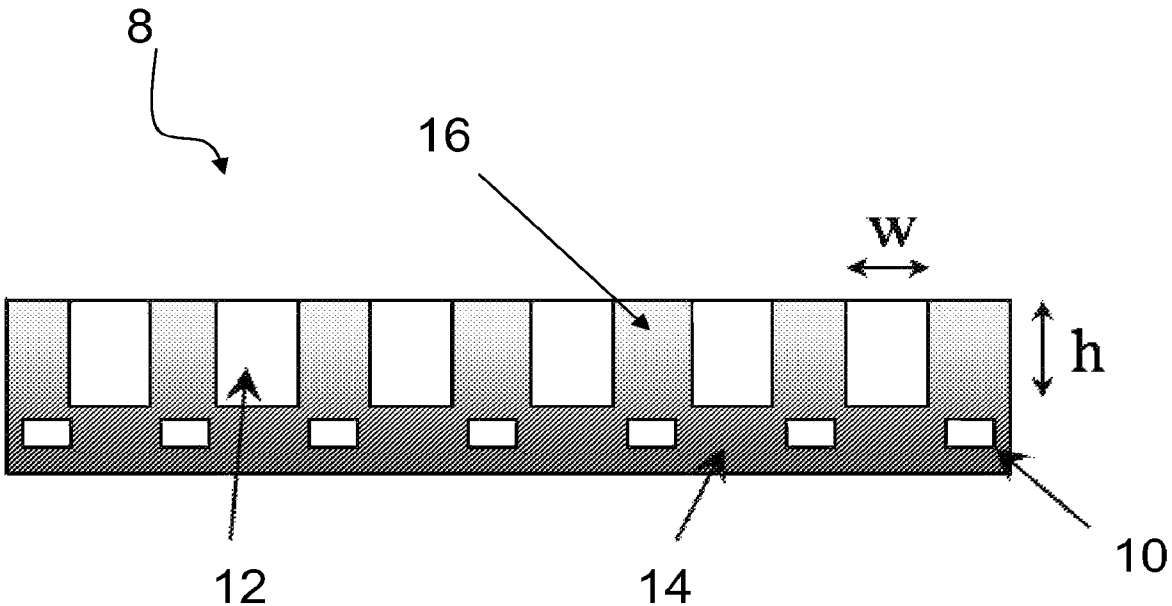
FIG. 1 is a schematic cross-sectional diagram of a preferred embodiment microplasma array of the invention with a complete set of driving electrodes fully integrated into a single unitary sheet.

Embodiments of the invention provide arrays of metal/metal oxide microplasma devices, including both microcavity and microchannel devices, that integrate complete driving (sustain) electrodes, electrical connections and microcavities and/or microchannels in a single, unitary sheet. Arrays of the invention can be fabricated by a simple and inexpensive wet chemical process. With complete microcavities/microchannels, driving electrodes, and interconnects in a unitary sheet, the difficulty of precisely aligning two separate sheets is eliminated, thereby simplifying the fabrication process. Large arrays of microplasma devices of the invention can be formed, and are suitable for many applications, such as lighting, displays, photomedicine, sterilization, and UV curing.

An embodiment of the invention is an array of microcavity plasma devices formed in a unitary sheet of oxide with embedded microcavities or microchannels and encapsulated metal driving electrodes isolated by oxide from the microcavities or microchannels and arranged so as to generate sustain a plasma in the embedded microcavities or microchannels upon application of time-varying voltage when a plasma medium (gase(es) or vapor(s) is contained in the microcavities or microchannels.

Embodiments of the invention provide monolithic sheets including arrays of micoplasma devices in which the electric field lines do not pass through a sheet-sheet interface to the second electrode. Arrays of the invention exhibit enhanced reliability and lifetime.

Preferred embodiments of the invention will now be discussed with respect to the drawings. The drawings include schematic representations, which will be understood by artisans in view of the general knowledge in the art and the description that follows. Features may be exaggerated in the drawings for emphasis, and features may not be to scale. Similar features in different figures are identified by common reference numbers.

FIG. 1 is a schematic cross-sectional diagram of a preferred embodiment microplasma array 8 of the invention having a plurality of microchannels 12, which can alternatively be microcavities, with a complete set of driving electrodes 10 fully integrated into a unitary sheet 14 of metal oxide. The microchannels 12 (or microcavities) contain a plasma medium (a gas, vapor or mixtures thereof). A plasma is excited by two or more of the driving electrodes 10. The driving electrodes can be electrically isolated from one another and can be aligned vertically with the dielectric barrier 16 (portions of the metal oxide 14). The array 8 generates a microplasma in a microchannel 12 (or microcavity) when a gas or vapor is contained therein and a time-varying voltage of the proper RMS value is applied between the pair of electrodes adjacent to the microchannel 12 (or microcavity). The array of microcavities or microchannels 12 is defined within the unitary thin sheet of oxide 14, and the metal driving electrodes 10 are enapsulated in the unitary sheet of oxide 14. The oxide 14 physically and electrically isolates the electrodes 10 from the microcavities or microchannels 12. The electrodes 10 are arranged to ignite a microplasma in one or more of the microcavities or microchannels, and are isolated by portions of the unitary sheet of oxide 14 from the one or more of the microcavities or microchannels 12.

Figure 2C:
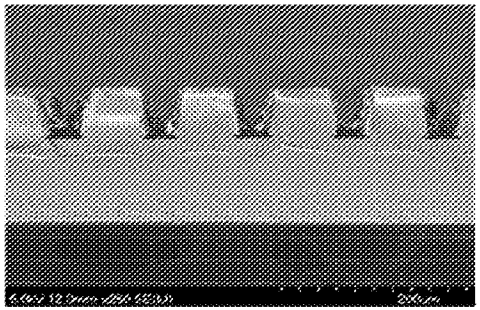
FIGS. 2A-2E are a series of scanning electron micrographs (of increasing magnification) showing an example prototype array of microchannel plasma devices of the invention.
Figure 2D:
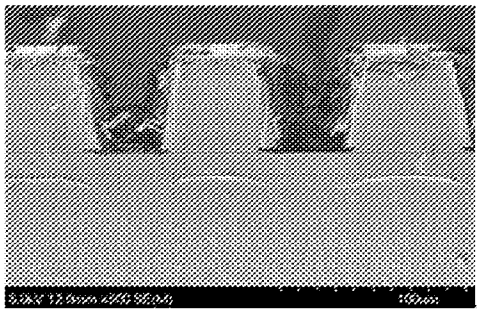
Figure 2E:
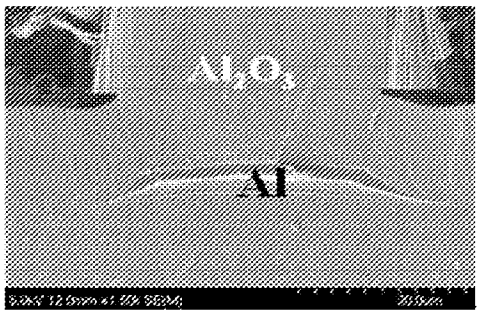
Figure 2A:
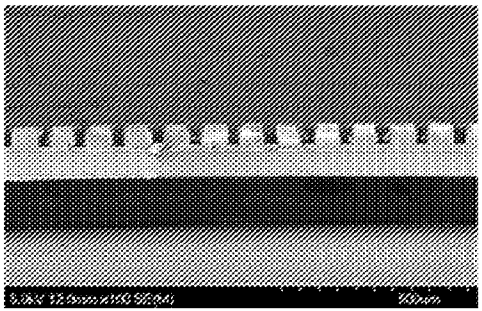
Figure 2B:
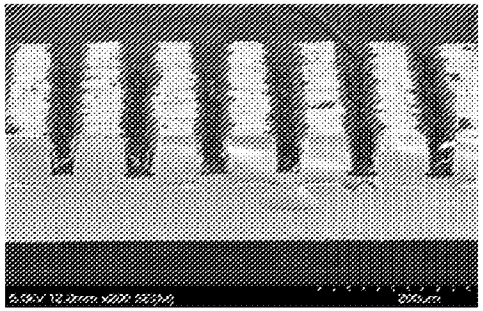

FIGS. 2A-2E are a series of scanning electron micrographs (of increasing magnification) showing an example prototype array of microchannel plasma devices formed in accordance with the array of FIG. 1. The example prototype array comprises microchannels having a length (i.e., dimension into the page) of 7 mm, a width (at the base) of nominally 40 μm and height of 50-60 μm. Notice that the microchannel cross-section in (best seen in FIG. 2D) is not rectangular but the channel sidewalls are slightly inclined outwards. The example prototype array was formed from an aluminum foil by converting substantially all of the aluminum sheet (except for the electrodes) into $Al_2O_3$ (aluminum oxide) by a wet chemical process. As illustrated in FIG. 1, all that remains of the original metal foil is the array of electrodes 10. As best seen in FIGS. 2D and 2E, the electrodes 10 have a slight crescent cross-sectional shape. Other metals and their oxides can also be used. For example, titanium and titanium oxide can be used.

Laboratory prototypes having microchannel widths as small as 30-40 μm have also been demonstrated successfully and commercial fabrication techniques and lithograph are capable fo producing even smaller widths, e.g., 10 μm. As noted above, the electrodes appear in FIGS. 2A-2E as a thin, crescent moon-shaped region lying below each barrier "rib" between the microchannels. These thin electrodes are able to drive microplasmas in the microchannels. In preferred methods of fabrication, the electrodes automatically form with a taper at the edges. This taper advantageously minimizes edge effects, thereby lowering the possibility for electrical breakdown of the dielectric and damaging of the arrays.

The FIG. 1 array 8 can be addressed by driving pairs of electrodes separately. This has been demonstrated in prototype microchannel devices. A voltage V is applied across the electrodes associated with (lying adjacent to) a given microchannel 12 to excite a plasma in that microchannel. In the experimental microchannel arrays, electrodes 10 of FIG. 1 extend out (are "run out" to the opposite sides of the array) to facilitate electrical connection. The applied voltage V is time-varying and can be, for example, sinusoidal, triangular, or pulsed (unipolar or bipolar). Example prototype addressable arrays of microchannel plasma devices have been operated in several hundred Torr of Ne as well as other rare gases. Addressability of these arrays has also been demonstrated—if the two electrodes associated with a particular channel are not energized, no plasma is formed with that channel.

Figures 3A, 3B, 3C, 3D, 3E, 3F, 3G, 3H:
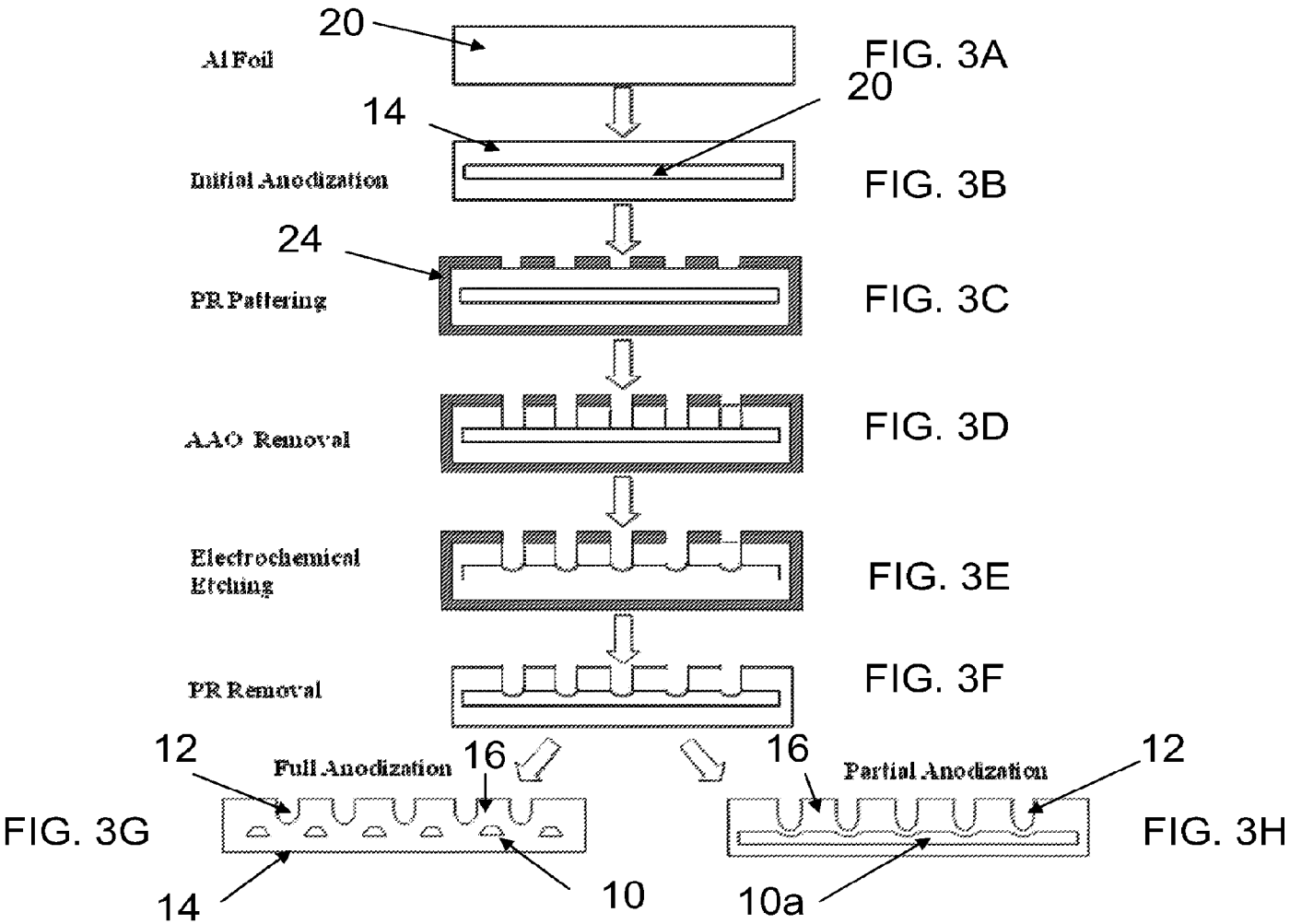
FIGS. 3A-3H illustrates a preferred embodiment method of fabrication for forming an array of microchannel or microcavity plasma devices of the invention.

FIGS. 3A-3H illustrate a preferred embodiment method for the fabrication of an array of microchannel or microcavity plasma devices of the invention. The method of FIG. 3A begins with a metal foil 20, such as Al foil. An initial anodization in FIG. 3B converts a substantial part of the metal foil 20 to metal oxide 14, leaving a thin portion of the original metal foil 20 encapsulated in oxide 14. In FIG. 3C, the oxidized foil is patterned with photoresist 24 on one surface of the foil and fully encapsulates it elsewhere (rear surface and sides). Patterning of the photoresist is accomplished by conventional photolithographic techniques. The pattern established in FIG. 3C establishes the dimensions and locations of the microcavities or microchannels and electrodes that will be formed. In FIG. 3D, windows in the oxide are opened by etching and, in FIG. 3E, the etchant is changed so as to remove a further portion of the metal foil 20. Photoresist is removed in FIG. 3F. A full anodization in FIG. 3G divides the foil 20 into segments to form individual electrodes 10 separated by oxide 14, thereby yielding an array an accordance with the array of FIGS. 1 and 2, having microcavities or microchannels 12 and associated electrodes 10 buried in oxide 14, all in a unitary single sheet. FIG. 3H shows the result of partial anodization, which would produce a common electrode 10*a*. The common electrode requires an external electrode to drive plasma generation in the microcavities or microchannels 12.

Figures 4A, 4B, 4C, 4D, 4E, 4F, 4G:
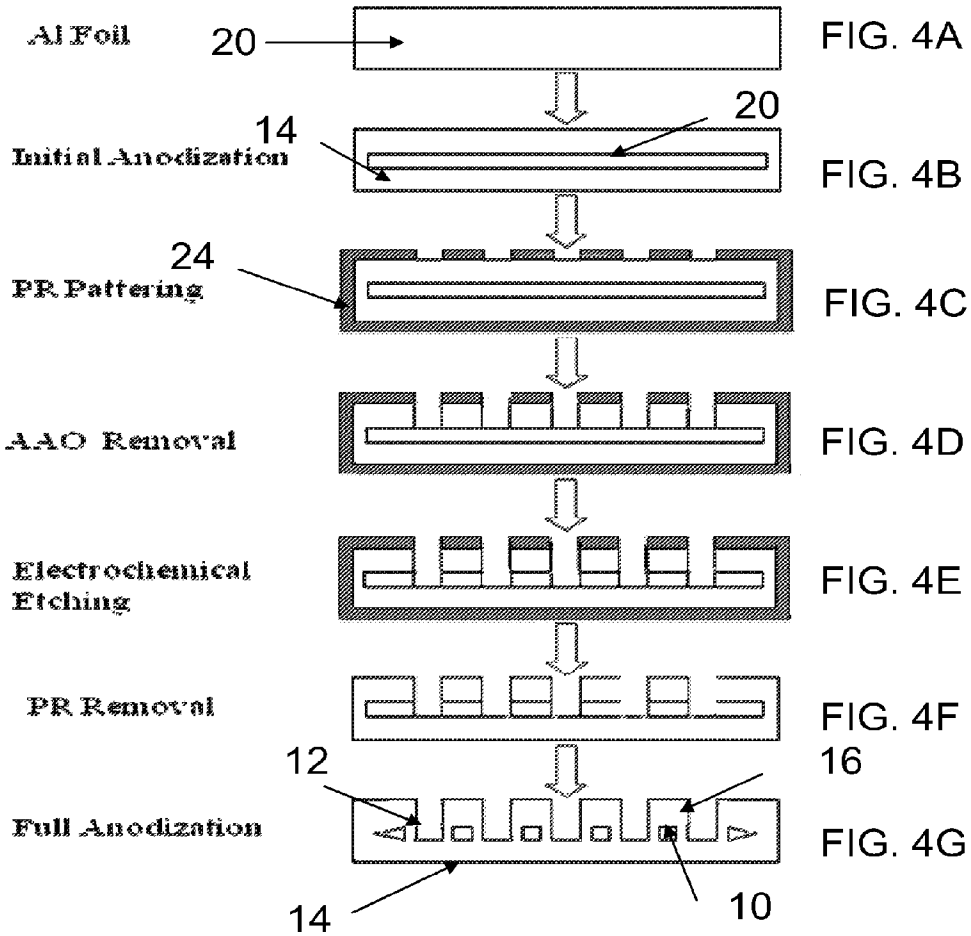
FIGS. 4A-4G illustrate another preferred embodiment method of fabrication for forming an array of microchannel or microcavity plasma devices of the invention that produces an array in which the electrode plane is situated such that the electrodes lie next to (not below) the microchannels or microcavities.

FIGS. 4A-4G illustrate another preferred embodiment method for fabrication of an array of microchannel or microcavity plasma devices of the invention. In FIGS. 4A-4B, the metal foil 20 is anodized to encapsulate a thin metal layer in metal oxide 14, as in FIGS. 3A-3B. FIGS. 4C-4D are comparable to FIGS. 3C-3D, but in FIG. 4E etching is continued all the way through the metal layer formed in FIG. 4B thus etching the foil 20 into separate, parallel segments, which will form electrodes 10. After photoresist removal in FIG. 4F, anodization completes and encapsulates the electrodes 10, adjacent to the microcavities 12, that are buried in the oxide 14. Advantageously, both fabrication methods in FIGS. 3 and 4 require only one photolithographic step (FIG. 3C and FIG. 4C). The FIG. 3 method produces the electrodes 10 lying below the microcavities or microchannels 12 (centered on the barriers 16 between microchannels). The method of FIG. 4, on the other hand, produces electrodes lying flush with, or slightly above, the bottom of the microcavities or microchannels 12. The methods of FIGS. 3 and 4 can produce electrodes and microcavities or microchannels in any pattern permitted by the photolithographic patterning step.

Figure 5:
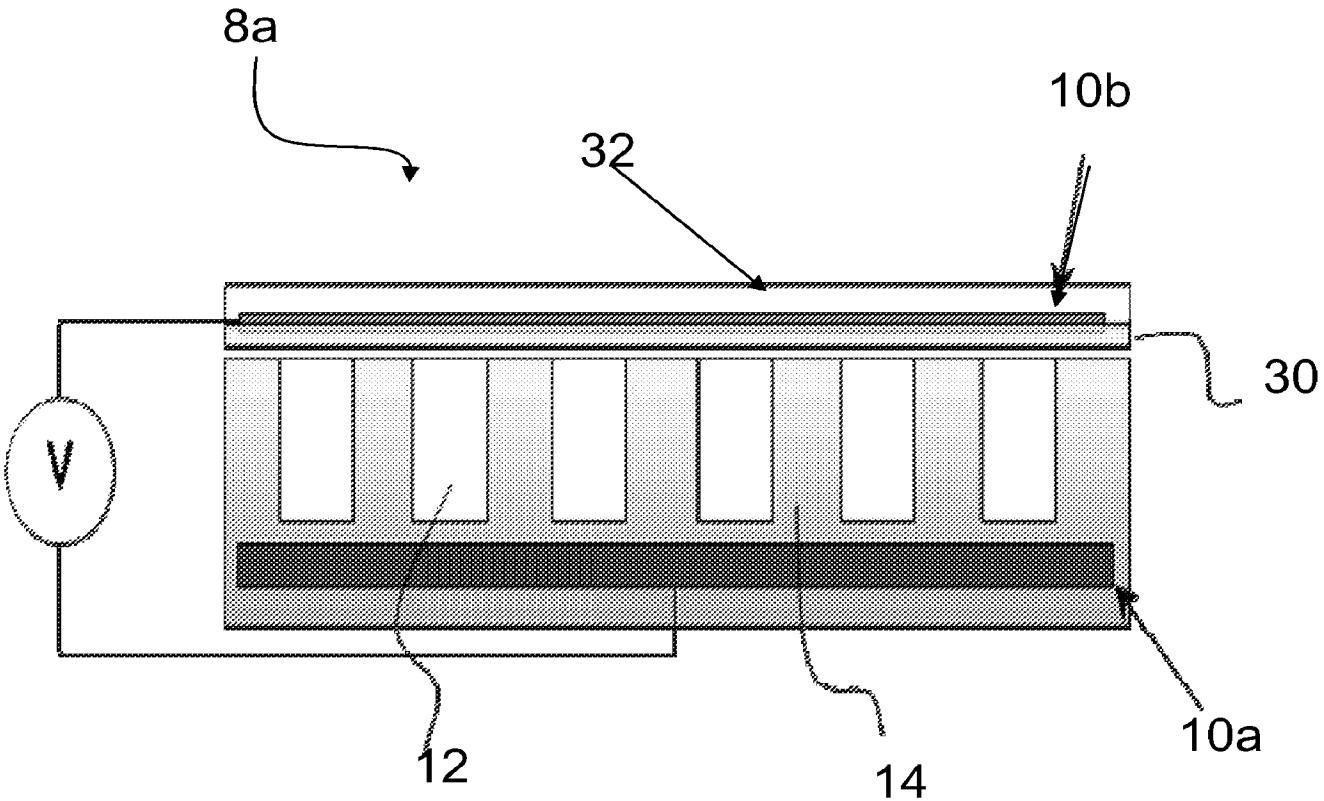
FIG. 5 is a schematic cross-sectional diagram of another preferred embodiment microplasma array of the invention.

FIG. 5 is a schematic cross-sectional diagram of another preferred embodiment microplasma array 8*a* of the invention that was fabricated to conduct experiments, and is useful in practice for many applications not requiring addressability. While the array 8*a* of FIG. 5 is not addressable, it is useful, for example as a light source such as for general lighting or as the backlight for an LCD display. For simple fabrication and testing connections, the lower electrode 10*a* was made continuous. Thus, the structure of most of FIG. 5 can be fabricated by the sequence of FIG. 3 by omitting the etching step of FIG. 3E. A separate external upper electrode 10*b* was used, and was isolated from the microcavities or microchannels 12 by a protective layer of dielectric 30. A window 32 sealed the array 8*a* and provided the surface onto which upper electrode 10*b* and dielectric layer 30 were deposited. A prototype in accordance with FIG. 5 was operated with various gases and gas mixtures as a plasma medium. The plasma medium can be contained at or near atmospheric pressure, permitting the use of a very thin glass or plastic layer as the window 32 or as packaging because of the small pressure differential across the packaging layer, which can also be two separate layers. Polymeric vacuum packaging, such as that used in the food industry to seal various food items, is also satisfactory as a packaging layer or window. The radiating area of the prototype array used in the experiments described above was several mm (width) by >5 cm in length.

Figure 6A:
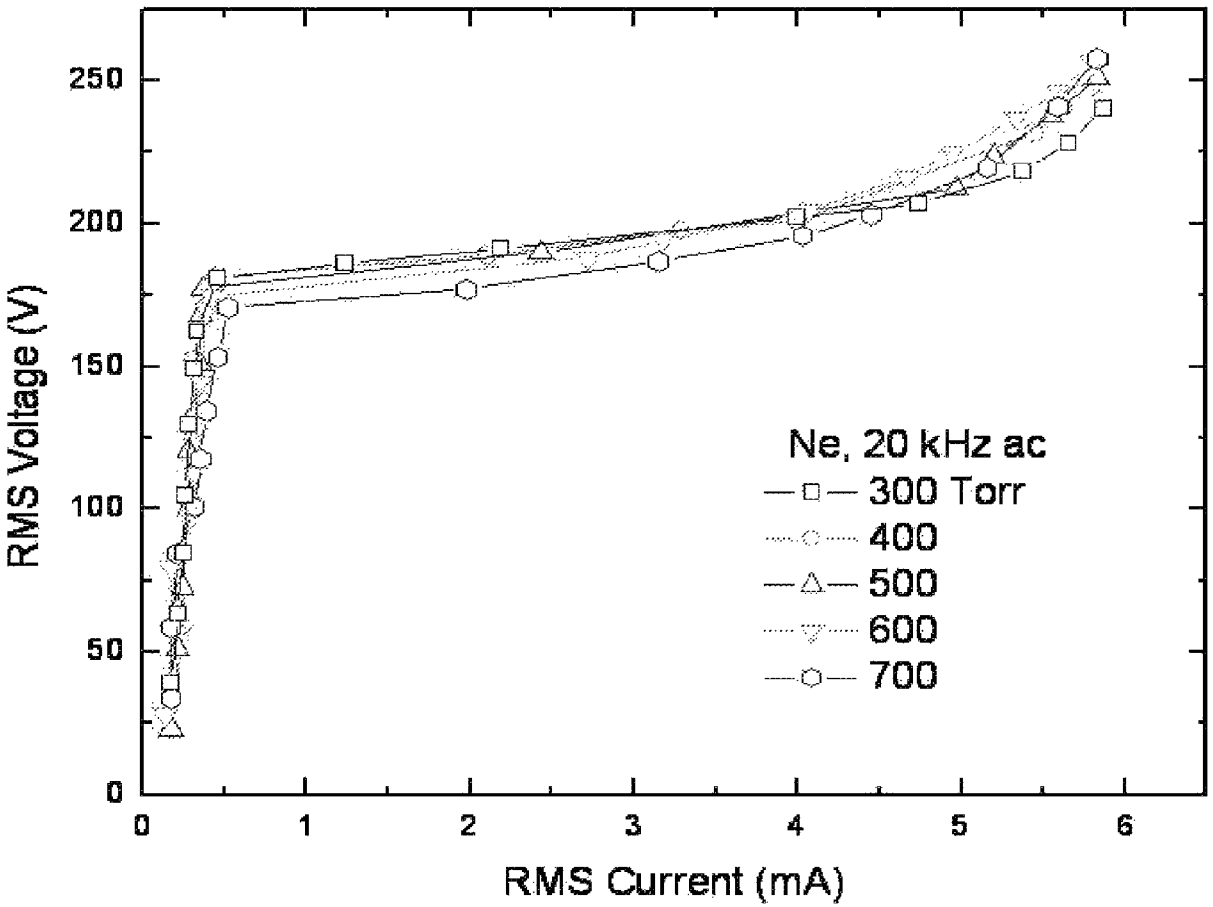
FIGS. 6A and 6B respectively show V-I and luminance data for a prototype array of microchannel plasma devices consistent with FIG. 5 and operated at pressures between 300 and 700 Torr with a driving voltage that is a 20 kHz sinusoid.
Figure 6B:
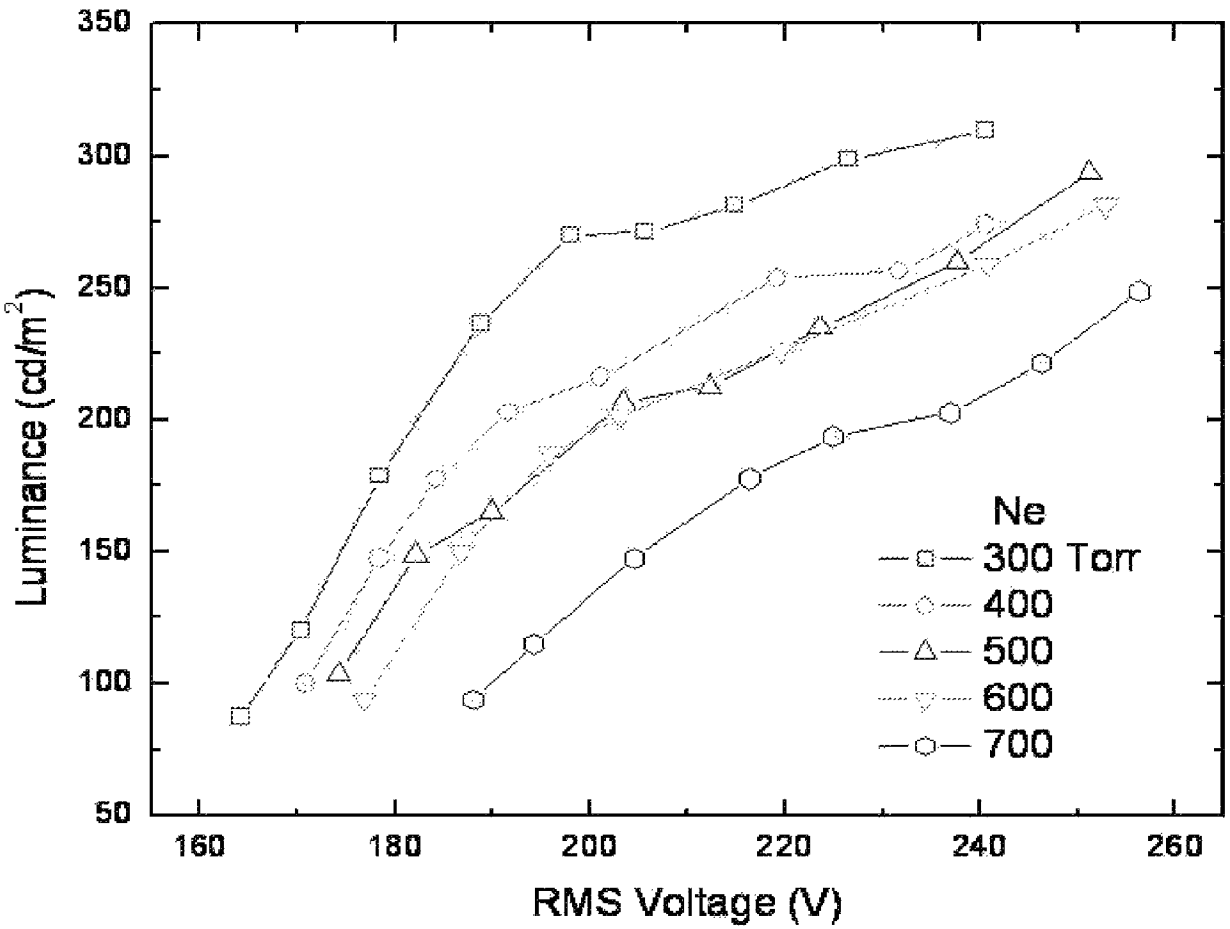

Data were taken with an experimental microchannel prototype according to FIG. 5, and show that the spatial uniformity of the emission is excellent. FIG. 6A presents voltage-current (V-I) measurements and FIG. 6B presents luminance data for the prototype microchannel array of FIG. 5 operated at pressures between 300 and 700 Ton with a 20 kHz sinusoidal driving voltage.

The experimental array was formed with an Al metal electrode 10*a* encapsulated in $Al_2O_3$. Since most of the original Al foil has been converted into nanoporous $Al_2O_3$, the capacitance and displacement current are both exceptionally low. Producing a plurality of electrodes as shown in FIGS. 3G and to 4G reduces the capacitance further. Low capacitance and displacement current are important for driving arrays of large area. The luminance of FIG. 6B peaks at ~300 cd/m$^2$, which is a good value for Ne (known to be an inefficient emitter).

Figure 7:
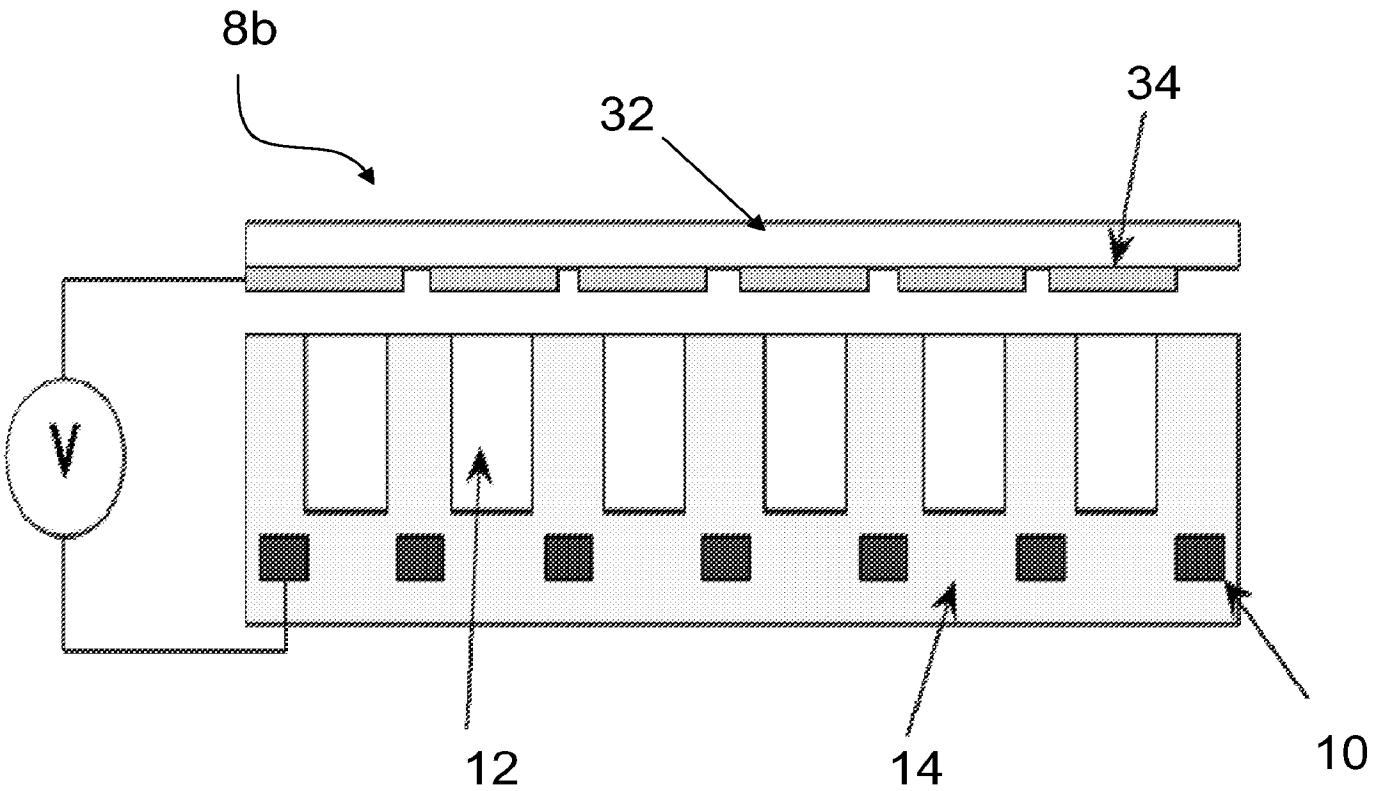
FIG. 7 is a schematic cross-sectional diagram of a preferred embodiment array of microchannel or microcavity plasma devices of the invention that includes a patterned electrode array on an output window.

Another preferred embodiment addressable array 8*b* based upon the FIG. 1 unitary electrode 10 and oxide sheet 14 structure is illustrated in FIG. 7. The complete set of driving (sustain) electrodes 10 is embedded in the single, unitary sheet of oxide 14. A set of addressing electrodes 34 is formed external to the sheet on a separate sheet or substrate 32, such as a transparent window. The addressing electrodes are spaced at a small distance from the microcavities 12 (or, alternatively, can be mounted directly onto oxide sheet 14). Electrodes 34 turn plasma on and off individual microcavities in cooperation with the sustain electrodes 10. The voltage applied across adjacent electrodes 10 in FIG. 7 is not shown.

Figure 8:
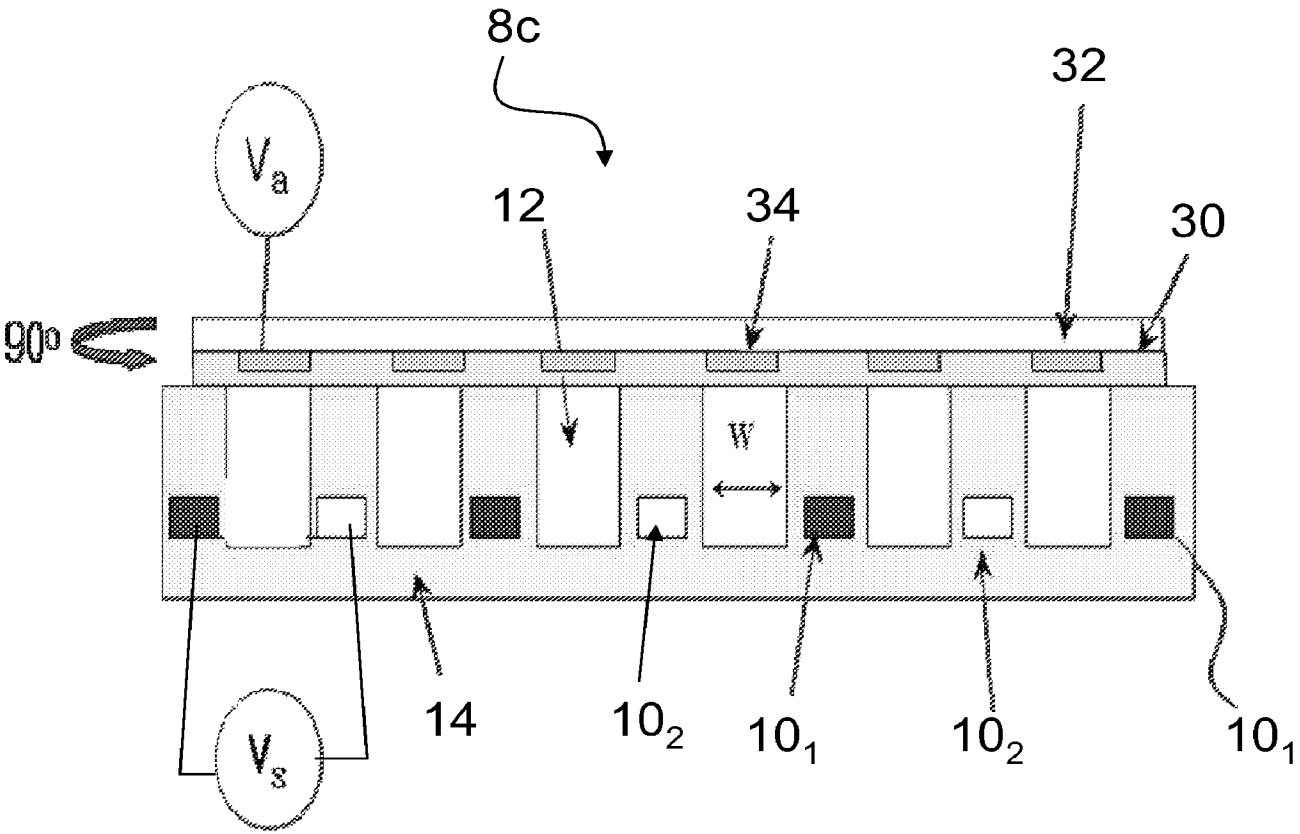
FIG. 8 is variation of the FIG. 7 array that includes a protective layer over transparent external electrodes and embedded electrodes that are flush or substantially flush with the bottom of the microchannels or microcavities.

FIG. 8 illustrates another preferred embodiment array 8*c* of microchannel or microcavity plasma devices. The array 8*c* includes a patterned electrode array 34 on its output window 32. A time-varying sustain voltage can be (as shown) applied between electrode pairs $\mathbf{10}_1$ and $\mathbf{10}_2$ and a transparent (e.g., indium tin oxide ITO) addressing electrode arrau 34 is used to address one or more microchannels or microcavities.

Figure 9:
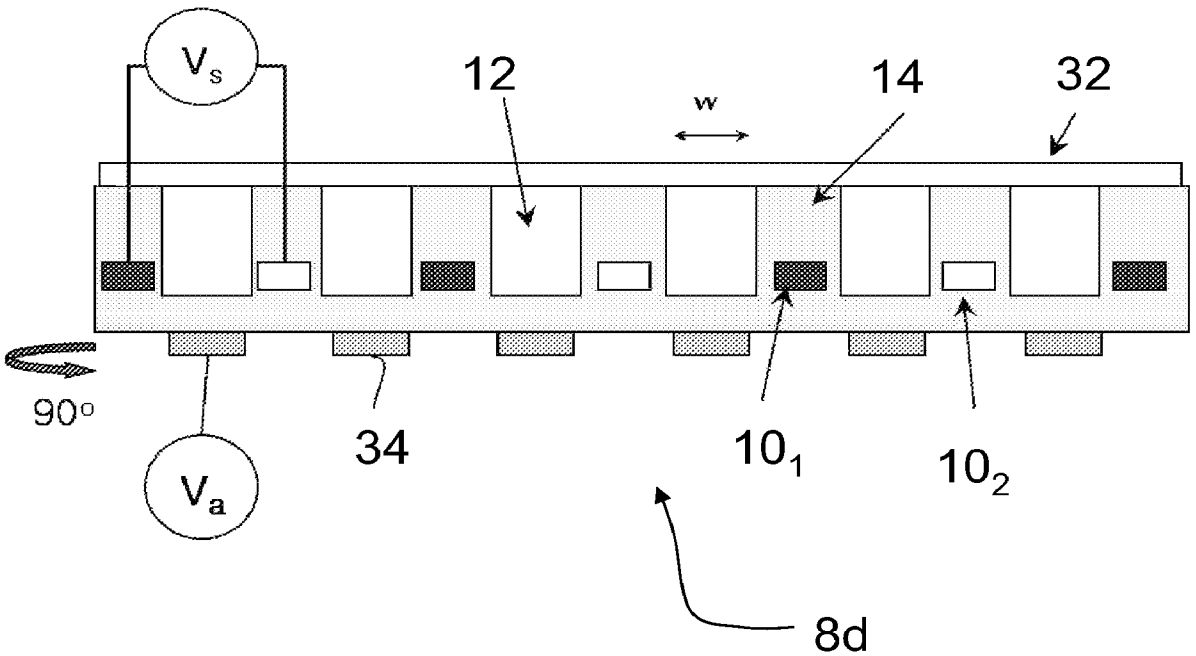
FIG. 9 is a schematic cross-sectional diagram of a preferred embodiment addressable microchannel or microcavity array with a complete set of driving (sustain) electrodes and interconnects in one sheet, and a third (external address) electrode.
Figure 10:
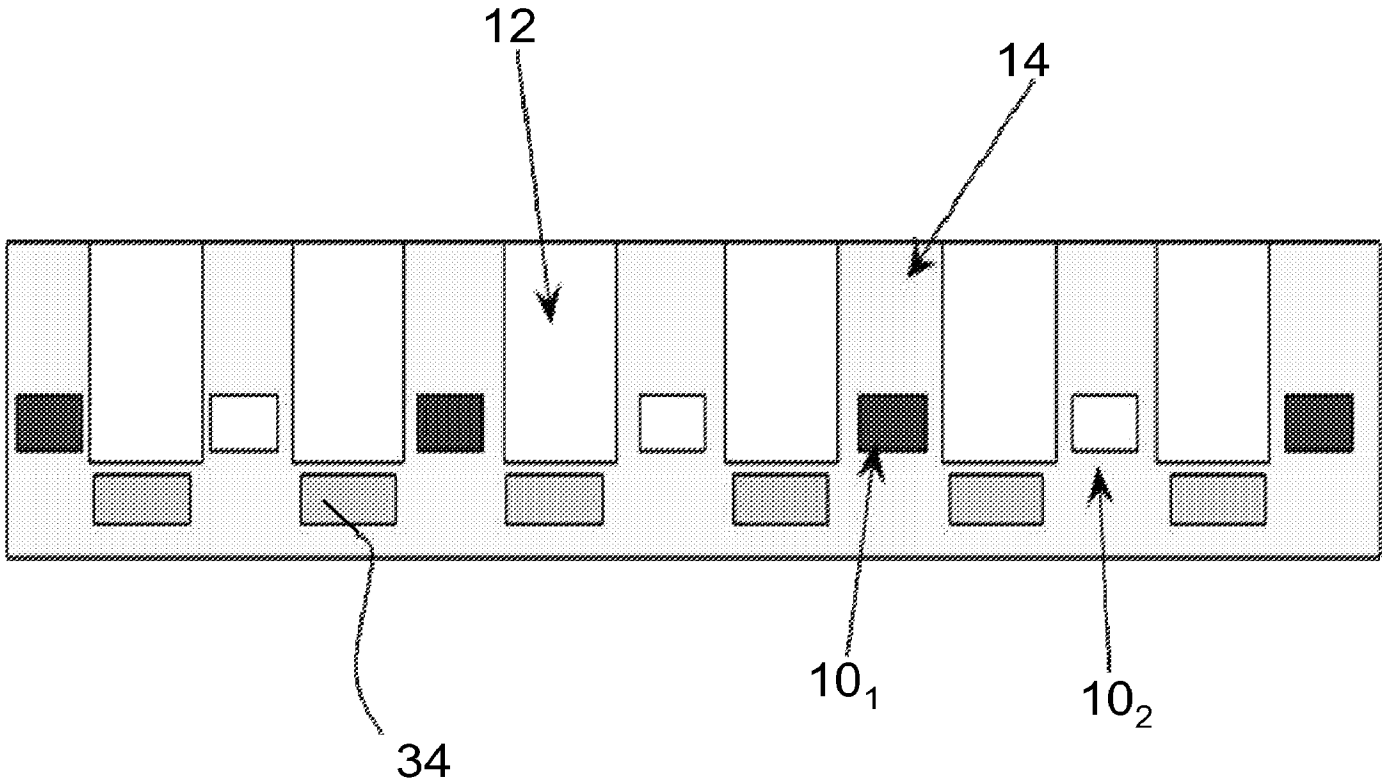
FIG. 10 is a schematic cross-sectional diagram of a preferred embodiment addressable microchannel or microcavity array with complete driving (sustain) electrodes and interconnects as well as a third (address) electrode in one sheet.
Figure 11:
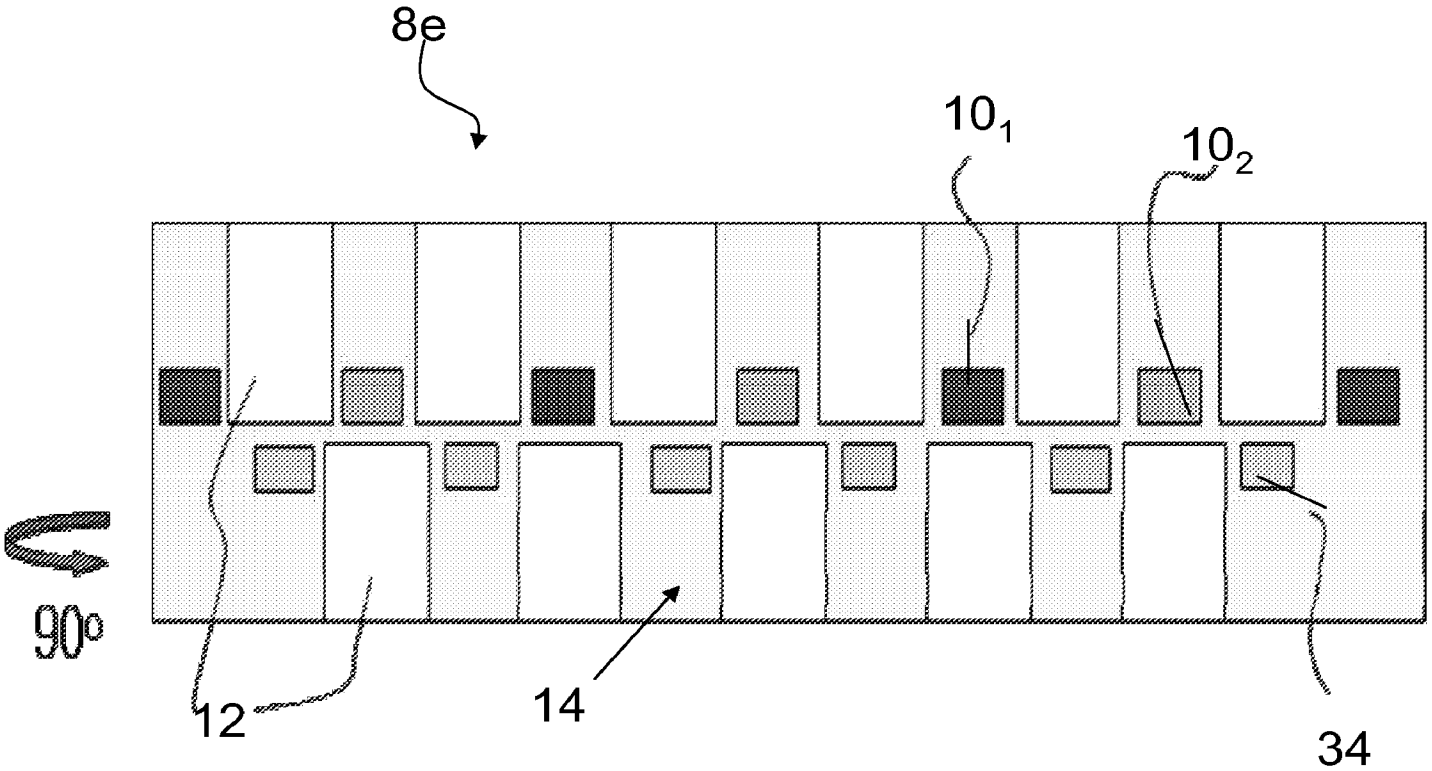
FIG. 11 is a variation of the FIG. 10 array that provides emission from both faces of the array.

FIG. 9 shows an array 8*d* that is a variation of the FIG. 8 array having address electrodes 34 on the backside of the unitary oxide layer 14, and the electrodes $\mathbf{10}_1$ and $\mathbf{10}_2$ positioned flush or substantially flush with the bottom of the microcavities or microchannels 12. FIG. 10 is a schematic cross-sectional diagram of another preferred embodiment addressable microchannel or microcavity array with a complete array of driving (sustain) electrodes $\mathbf{10}_1$ and $\mathbf{10}_2$ in a first plane and a complete array of address electrodes 34 in a second plane, all in one unitary sheet of oxide 14. FIG. 11 shows a double sided array 8*e* that is a variation of the FIG. 10 array providing emission from both faces of the array 8*e*. The address electrodes 34 can be used to make a vertical discharge along with electrodes $\mathbf{10}_1$ and $\mathbf{10}_2$. The electrode 34 can also perform special functions such as electron emission or switching. Electron emission from the electrodes 34 is accomplished with the oxide 14 as a thin tunneling barrier. Additionally, the orientation of the electrode arrays can be aligned to be parallel or crossed.

Figure 12:
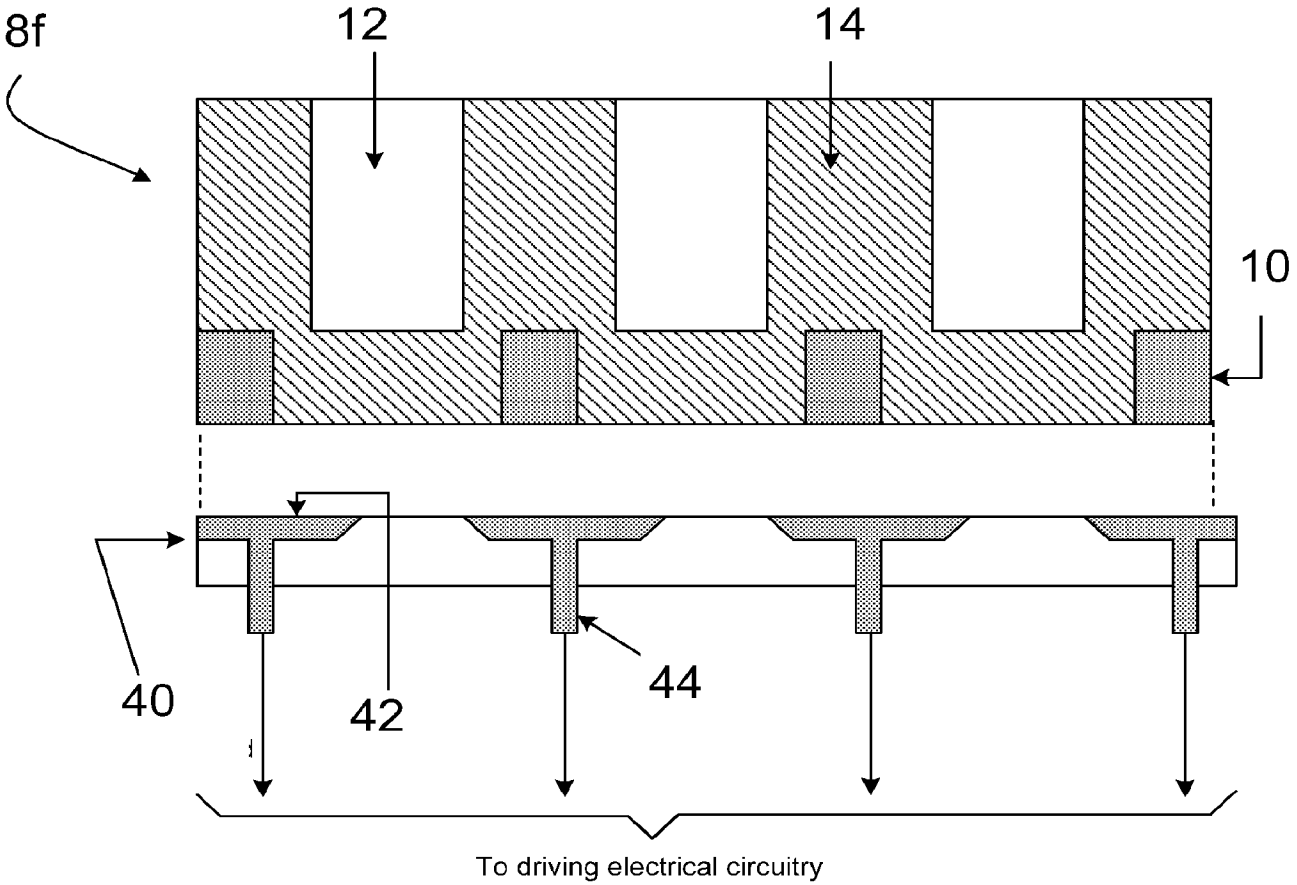
FIG. 12 is a schematic cross-sectional diagram of a preferred embodiment addressable microchannel or microcavity array of the invention that enables electrical contacts to be made at the back side of the array.

FIG. 12 a schematic cross-sectional diagram of a preferred embodiment microcavity or microchannel array 8*f* of the invention having the sustain electrodes 10 exposed on the backside of the oxide layer 14. This permits electrical contact to be made at the back of the array (as opposed to the edges), by chip bonding techniques. In FIG. 12, a substrate 40, such as a PCB board, carries contact pads 42 terminating in electrical pins 44 for contact to the external driving circuitry. The pads 42 contact the electrodes 10 on the back side of the array 8*f*.

Figures 4D, 13A, 13B, 13C:
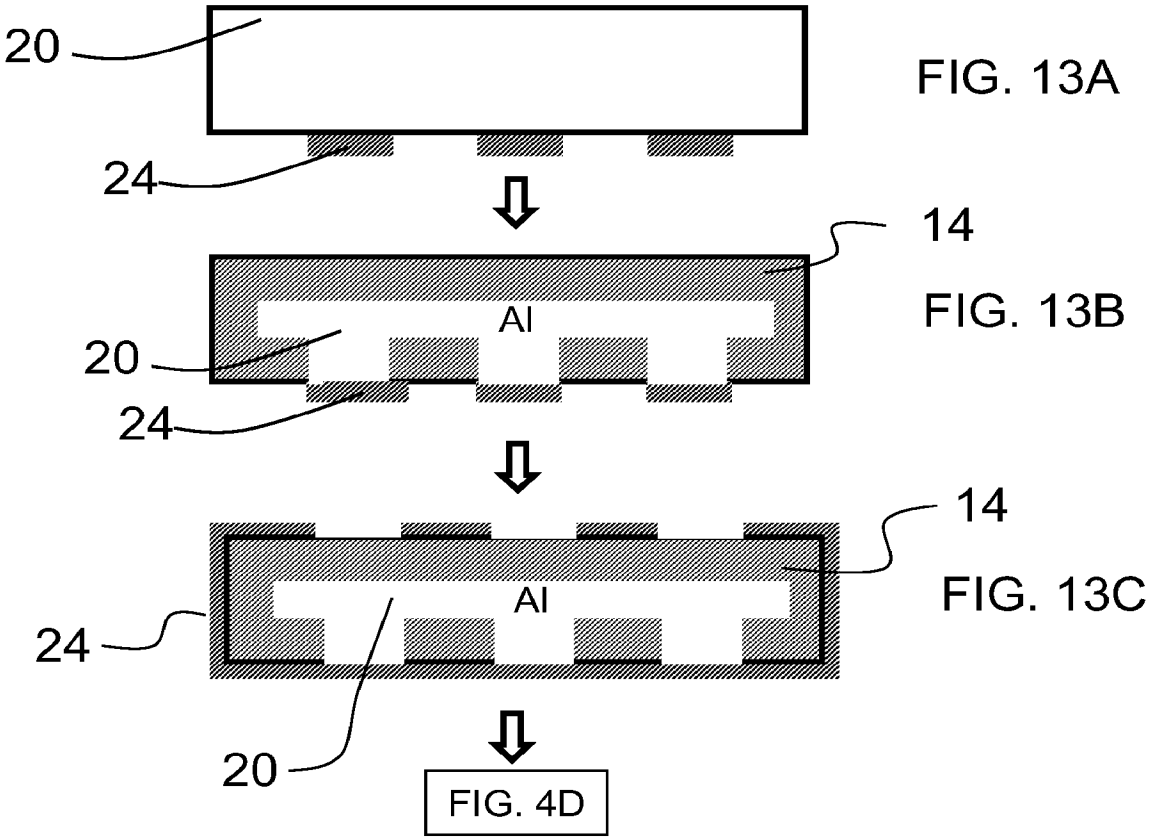
FIGS. 13A-13C illustrate initial steps of another preferred embodiment method of fabrication that is a modification of the FIGS. 4A-4G method for forming an array of microchannel or microcavity plasma devices of the invention and that can be used to fabricate the array of FIG. 10.

FIGS. 13A-13C illustrate a fabrication method of the invention that can be used to fabricate arrays of microcavity or microchannel plasma devices in a unitary, single sheet with two arrays of embedded electrodes in different planes, such as in the array of FIG. 10. The FIGS. 13A-13C steps replace the steps in FIGS. 4A-4C. After the steps of FIGS. 13A-13C are conducted, the method is completed by following the steps of FIGS. 4D-4G. The method of FIG. 13A begins by applying photo resist in a pattern corresponding to the electrodes 34 of FIG. 10 to a metal foil 20, such as Al foil. An initial anodization in FIG. 3B converts a substantial part of the metal foil 20 to metal oxide 14, leaving portions of the original metal foil 20 encapsulated in oxide 14. In FIG. 13C, the oxidized foil is patterned with photoresist 24, in the pattern that will define locations of the electrodes $\mathbf{10}_N$ in FIG. 10. Carrying out the remaining steps in FIGS. 4D-4G results in the array of FIG. 10.

Figures 14A, 14B, 14C, 14D, 14E, 14F:
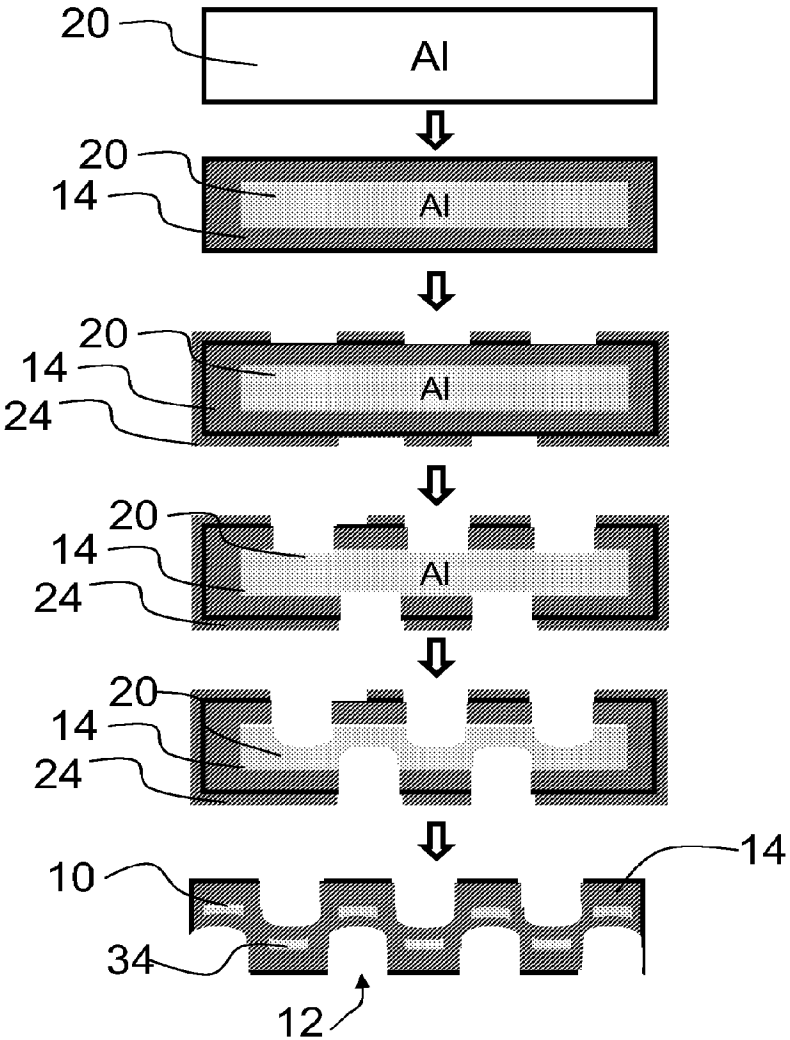
FIGS. 14A-14F illustrate another preferred embodiment method of fabrication that is a modification of the FIGS. 3A-3G method for forming an array of microchannel or microcavity plasma devices of the invention and that can be used to fabricate the array of FIG. 11.

FIGS. 14A-14F illustrate a fabrication method of the invention that can be used to fabricate arrays of microcavity or microchannel plasma devices in a unitary, single sheet with two arrays of embedded electrodes in different planes and front side and backside microcavities or microchannels, such as in the array of FIG. 11. The FIGS. 14A-14F method is a modified version of the FIGS. 3A-3G method, but forms an additional array of microcavities or microchannels 12 opening on back side of the unitary sheet. In FIGS. 14A and 14B, the metal foil 20 is anodized as in FIGS. 3A and 3B to convert a substantial portion to oxide 14. FIG. 14C the photoresist 24 is patterned on both sides of the oxide encapsulated foil. In FIG. 14D, windows in the oxide are opened by etching. In FIG. 14E, the etchant is changed so as to remove a further portion of the metal foil 20. Photoresist is then removed and a full anodization in FIG. 3F divides the foil 20 into segments to form individual encapsulated electrode arrays 10 and 34 that are electrically and physically isolated from the microcavities or microchannels 12 by oxide 14.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. An array of microplasma devices, comprising:

a unitary single monolithic thin sheet of oxide having an array of microcavities or microchannels defined within the unitary single monolithic thin sheet of oxide;

a complete set of metal driving electrodes fully encapsulated with respect to the microcavities or microchannels within the unitary single monolithic thin sheet of oxide, said driving electrodes being arranged with respect to each other to ignite a microplasma in one or more of said microcavities or microchannels, said driving electrodes being physically and electrically isolated by portions of the unitary single monolithic thin sheet of oxide from the one or more of said microcavities or microchannels, and wherein pairs of said driving electrodes are isolated from each other by portions of the unitary single monolithic thin sheet of oxide.

2. The array of claim 1, wherein the oxide comprises aluminum oxide and the driving electrodes comprise aluminum.

3. The array of claim 1, further comprising address electrodes for addressing the one or more microcavities.

4. The array of claim 3, wherein the address electrodes are encapsulated within the unitary single monolithic thin sheet of oxide.

5. The array of claim 3, wherein the address electrodes are external to the unitary single monolithic thin sheet of oxide.

6. The array of claim 5, wherein the address electrodes are formed on a backside of the unitary single monolithic thin sheet of oxide.

7. The array of claim 5, wherein the address electrodes are formed on a separate substrate or sheet.

8. The array of claim 5, wherein the address electrodes are formed on a window.

9. The array of claim 8, wherein the window seals the microcavities or microchannels.

10. The array claim 9, wherein further comprising a protective dielectric layer to isolate the address electrodes from the microcavities.

11. The array of claim 1, wherein the driving electrodes are situated below the microcavities or microchannels.

12. The array of claim 1, wherein the driving electrodes are adjacent the microcavities.

13. The array of claim 1, wherein the driving electrodes are exposed on a backside of the unitary single monolithic thin sheet of oxide.

14. The array of claim 13, further comprising a substrate carrying contact pads that contact the driving electrodes, the contact pads terminating in pins for connection to driving circuitry.

15. The array of claim 1, further comprising a plasma medium contained in the microcavities or microchannels.

16. The array of claim 1, comprising a second array of microcavities or microchannels defined in the unitary single monolithic thin sheet of oxide and opening to the backside of the unitary single monolithic sheet.

17. An array of microcavity plasma devices, comprising a unitary single monolithic sheet of oxide with embedded microcavities or microchannels and a complete set metal driving electrodes fully encapsulated with respect to the microcavities or microchannels within the unitary single monolithic sheet of oxide and physically and electrically isolated by oxide of the unitary single monolithic sheet from each other and from the microcavities or microchannels and arranged to sustain a plasma in the embedded microcavities or microchannels upon application of time-varying voltage when a plasma medium is contained in the microcavities or microchannels.

18. The array of claim 17, wherein sets of the driving electrodes are isolated from other sets of the driving electrodes.

19. The array of claim 17, wherein the driving electrodes are below the microcavities or microchannels.

20. The array of claim 17, wherein the driving electrodes are adjacent the microcavities.

21. The array of claim 17, wherein the driving electrodes are exposed on a backside of the unitary single monolithic thin sheet of oxide.

22. The array of claim 17, wherein the oxide comprises aluminum oxide and the driving electrodes comprise aluminum.

23. The array of claim 17, wherein the microcavities or microchannels have a non-uniform cross-section.

24. The array of claim 17, wherein the driving electrodes have a crescent shape.

25. The array of claim 17, wherein the driving electrodes have tapered edges.

26. A method of forming an array of microplasma devices, the method comprising steps of:

initially anodizing a metal foil to encapsulate the metal foil in oxide;

forming a pattern of protective resist with openings on a surface of the foil that can define one of microcavities or microchannels on the encapsulated metal foil, removing oxide through the openings;

electrochemically etching through the openings to remove metal and complete microcavities or microchannels;

removing the protective resist;

final anodizing to create driving electrodes near the microcavities or microchannels.

27. The method of claim 26, wherein said step of final anodizing forms an array of driving electrodes.

28. The method of claim 26, wherein said step of final anodizing forms a common electrode.

29. The method of claim 26, wherein said step of forming forms a pattern of protective resist with openings on front and back surfaces of the foil.

30. An array of microcavity plasma devices, consisting of:

a unitary single monolithic thin sheet of oxide with embedded microcavities or microchannels and a complete set metal driving electrodes fully encapsulated with respect to the microcavities or microchannels within the unitary single monolithic thin sheet of oxide and physically and electrically isolated by oxide of the unitary single monolithic thin sheet from each other and from the microcavities or microchannels and arranged to sustain a plasma in the embedded microcavities or microchannels upon application of time-varying voltage when a plasma medium is contained in the microcavities or microchannels;

plasma medium within the microcavities or microchannels; and packaging to package the unitary single monolithic thin sheet of oxide and contain the plasma medium within the embedded microcavities or microchannels and a voltage source for supplying the time-varying voltage.

31. The array of claim 30, wherein the packaging consists of thin glass or polymer vacuum packaging.

32. An array of microcavity plasma devices, consisting of:

a unitary single monolithic thin sheet of oxide with embedded microcavities or microchannels and a complete set metal driving electrodes fully encapsulated with respect to the microcavities or microchannels within the unitary single monolithic thin sheet of oxide and physically and electrically isolated by oxide of the unitary single monolithic thin sheet from each other and from the microcavities or microchannels and arranged to sustain a plasma in the embedded microcavities or microchannels upon application of time-varying voltage when a plasma medium is contained in the microcavities or microchannels;

plasma medium within the microcavities or microchannels;

address electrodes encapsulated within said unitary single monolithic thin sheet of oxide, formed on a backside of said unitary single monolithic thin sheet of oxide, formed on said packaging or formed on, within or upon a second unitary monolithic thin single sheet of oxide, or within or upon substrate; and packaging to package the array and contain the plasma medium within the embedded microcavities or microchannels and a voltage source for supplying the time-varying voltage and voltage to the address electrodes.

33. The array of claim 32, wherein the packaging consists of thin glass or polymer vacuum packaging.

* * * * *

UNITED STATES PATENT AND TRADEMARK OFFICE

CERTIFICATE OF CORRECTION

PATENT NO. : 8,890,409 B2
APPLICATION NO. : 12/991237
DATED : November 18, 2014
INVENTOR(S) : J. Gary Eden et al.

It is certified that error appears in the above-identified patent and that said Letters Patent is hereby corrected as shown below:

In the Specification:

| | |
|---|---|
| Col. 3, line 45 | Insert a --)-- after "vapor(s)". |
| Col. 6, line 6 | Delete "Ton" and insert --Torr-- therefor. |
| Col. 6, line 34 | Delete "arrau" and insert --array-- therefor. |

In the Claims:

| | |
|---|---|
| Col. 8, line 12, Claim 10 | Delete "wherein". |

Signed and Sealed this
Third Day of November, 2015

Michelle K. Lee

Michelle K. Lee
*Director of the United States Patent and Trademark Office*